United States Patent [19]

Matsui

[11] 4,079,651

[45] Mar. 21, 1978

[54] TOUCH RESPONSE SENSOR FOR AN ELECTRONIC MUSICAL INSTRUMENT

[75] Inventor: Shigeru Matsui, Hamamatsu, Japan

[73] Assignee: Nippon Gakki Seizo Kabushiki Kaisha, Japan

[21] Appl. No.: 762,558

[22] Filed: Jan. 25, 1977

[30] Foreign Application Priority Data

| | | |
|---|---|---|
| Jan. 30, 1976 | Japan | 51-9354[U] |
| Jan. 30, 1976 | Japan | 51-9355[U] |
| Apr. 26, 1976 | Japan | 51-52323[U] |
| Apr. 26, 1976 | Japan | 51-52324[U] |

[51] Int. Cl.[2] ..... G10H 3/00

[52] U.S. Cl. ..... 84/1.1; 84/DIG. 7; 338/69

[58] Field of Search ..... 84/1.01, 1.09–1.1, 84/1.14, 1.27, DIG. 7; 338/69.96, 114, 47; 200/159 B, 5 A, 5

[56] References Cited

U.S. PATENT DOCUMENTS

| | | | |
|---|---|---|---|
| 1,051,675 | 1/1913 | Breed | 84/1.1 |
| 3,327,045 | 6/1967 | Olson | 84/1.01 |
| 3,328,507 | 6/1967 | Peterson | 84/1.26 |
| 3,657,459 | 4/1972 | Peterson et al. | 84/1.01 |
| 3,657,460 | 4/1972 | Cutler | 84/1.01 |
| 3,927,593 | 12/1975 | Kawamura | 84/1.01 |
| 3,960,044 | 6/1976 | Nagai et al. | 84/1.01 |

*Primary Examiner*—Robert K. Schaffer
*Assistant Examiner*—Vit W. Miska
*Attorney, Agent, or Firm*—Ladas, Parry, Von Gehr, Goldsmith & Deschamps

[57] ABSTRACT

This invention relates to a touch response sensor for an electronic musical instrument which may control the volume, pitch, tone-color or the like of the musical tones produced by the instrument upon depression of the key responsive to the key depressing pressure. In order to detect the key depressing pressure, the touch response sensor has an electrically conductive resilient member having two legs downwardly extending therefrom for producing resistance variations between contact pieces provided on a base plate under the resilient member in response to the key depressing pressure. The contact pieces are, for example, connected via lines to a voltage-controlled variable-frequency oscillator circuit, voltage-controlled variable filter circuit, voltage-controlled variable gain amplifier circuit or the like so as to vary the volume and the like of the tones in accordance with the key depressing pressure.

7 Claims, 17 Drawing Figures

TOUCH RESPONSE SENSOR FOR AN ELECTRONIC MUSICAL INSTRUMENT

BACKGROUND OF THE INVENTION

This invention relates to a touch response sensor of a keyboard type electronic musical instrument to perform touch control upon depression of keys and more particularly, to an after-control sensor for the electronic musical instrument capable of varying the volume or the like of musical tones to be produced in response to intentional change of key depressing pressure after normal depression of the keys. Generally, the feelings of a performer can be expressed in musical tones through the key depressing operation of the organ by controlling the volume, pitch, tone-color or the like in response to the performer's finger touch in the attack and sustain states of the tones, which is called "touch control". More specifically, the volume, pitch, tone-color or the like of the tones being played may be changed responsive to a conscious variation of the key depressing pressure after a normal or initial depression of the keys to be played, which is called "after-control". For achieving such touch control there is needed a device for detecting the key depressing pressure upon depression of the keys, which device is required to have an insensible region with regard to the increase of the key depressing pressure. This insensible region means a range where the touch control is not effective under a normal depressing pressure so that the touch control is not executed in ordinary key depressing operation but is effected only upon a conscious increase of the key depressing pressure for performing the positive touch control. The device is also required to detect the key depressing pressure sensitively in response to the key touching operation by the performer's fingers once the touch control is conducted by the conscious increase in the key touching pressure.

Heretofore, as shown in FIG. 1, the prior art touch control sensor of the electronic musical instrument has an electrically conductive cylindrical rubber member 2 fixed to a predetermined position of the lower surface of a key 1, and stationary contact members 4 and 5 spaced in parallel with each other and fixed onto a base plate 3 and having contact pieces 4*a* and 5*a*, respectively of suitable configurations such as a substantial triangular shape and located at the position opposite to the rubber member 2. Upon depression of the key the conductive member 2 come into contact with the contact pieces 4*a* and 5*a* of the contact members 4 and 5 to electrically connect the contact pieces 4*a* with 5*a*. When the key depressing force is weak, the rubber member 2 is not so deformed in shape, as designated by a solid line in FIG. 2, and, accordingly, the area where the rubber member 2 is in contact with the contact pieces 4*a* and 5*a* is small. If the key depressing force is strong, the rubber member 2 is flattened as shown by two-dotted broken line in FIG. 2, and therefore the contacting area of the member 2 with the contact pieces 4*a* and 5*a* increases.

Thus, the contacting area of the rubber member 2 with the contact pieces 4*a* and 5*a* of the members 4 and 5 is varied in response to the strength of the key depression, resulting in variation of the resistance value therebetween in response to the key depression. If the contacting area increases, the resistance value decreases. The key depressing pressure is thus detected based on the variation of the resistance.

However, the aforementioned sensor is inconvenient for the after-control purpose because the cylindrical conductive rubber member is not distorted in exact proportion to the key depressing force when the key is further deeply depressed for the after-control since it becomes more easily deformable, if once distorted, due to its specific characteristics owing to its cylindrical shape. In addition, since the maximum contacting area of the rubber member of the after-control sensor is obtained in a state wherein the cylindrical rubber member is collapsed to almost half from its original configuration, the sensor cannot detect a stronger key depressing force. Another disadvantage exists in the complicated molding of the cylindrical conductive rubber members.

SUMMARY OF THE INVENTION

It is, therefore, an object of this invention to provide a touch response sensor for an electronic musical instrument of a remarkably compact construction capable of directly disposing the sensor onto a printed substrate.

It is another object of the invention to provide a touch response sensor for an electronic musical instrument capable of detecting the key depressing pressure sensitively in response to the key touching operation by a performer's fingers once the touch control is conducted.

It is another object of the invention to provide a touch response sensor for an electronic musical instrument in which the variation in resistance between contact pieces upon further depression of keys after the normal depression of the keys is obtained by adopting the substantially inverted V-shaped conductive or resistant resilient member as an area variable contacting member.

It is another object of the invention to provide a touch response sensor for an electronic musical instrument capable of providing an easy after-control by forming the contacting area of the respective stationary contact pieces with the substantially inverted V-shaped conductive or resistant resilient member in such a manner that the contacting area increases toward the center of the member so as to expand the expression of musical tones with the touch response of the keys being depressed.

It is another object of the invention to provide a touch response sensor for an electronic musical instrument capable of varying the volume, pitch, tone-color or the like by variations of voltage value by means of resistance value in response to the key depressing pressure with substantially inverted V-shap resilient member together with contact pieces.

Other objects and features of the invention will become apparent from the description made hereinbelow with reference to the accompanying drawings.

DESCRIPTION OF THE PREFERRED EMBODIMENTS

Figure 1:
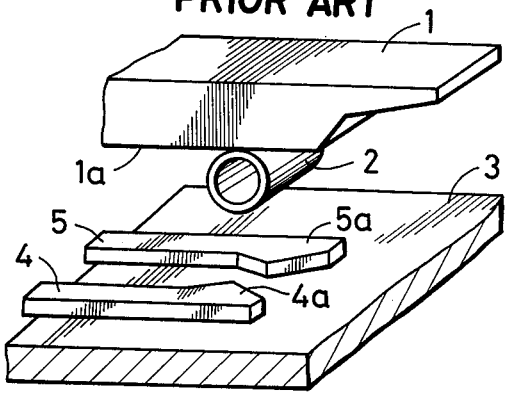
FIG. 1 PRIOR ART
FIG. 1 is a perspective view of the essential part of the conventional touch response sensor for an electronic musical instrument.
Figure 2:
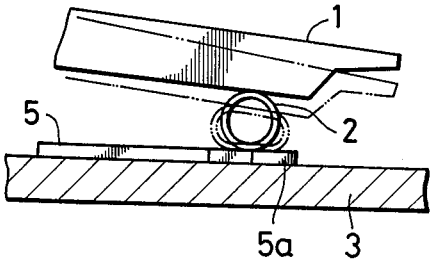
FIG. 2 PRIOR ART
FIG. 2 is a side view of the conventional touch response sensor shown in FIG. 1 for explaining the operation thereof.
Figure 3:
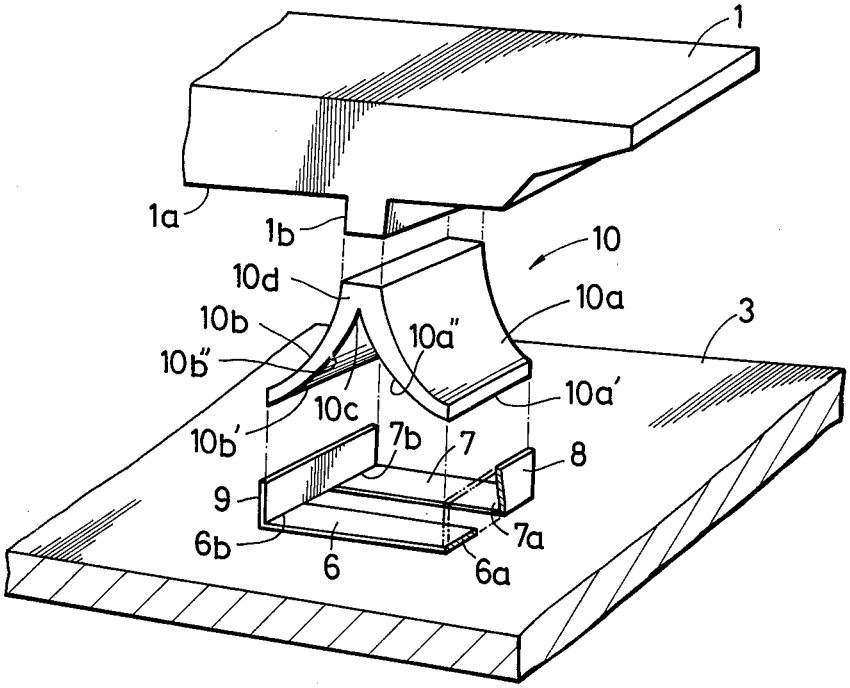
FIG. 3 is an exploded perspective fragmentary view of one embodiment of the touch response sensor for an electronic musical instrument according to this invention.

Referring first to FIG. 3, which shows one preferred embodiment of the touch response sensor for an electronic musical instrument according to the present invention, a projection 1*b* is downwardly extending from a predetermined position of the lower surface 1*a* of a key 1. Stationary contact pieces 6 and 7 of a substantially rectangular shape are arranged in parallel and spaced away from each other at a position opposite to the projection 1*b* of the key 1 on a base plate 3, and are electrically connected respectively to the electric circuit (not shown) of the electronic musical instrument. The aforesaid contact pieces 6 and 7 are formed or attached on the base plate 3 by printing or other suitable means. Stopper or engaging members 8 and 9 are fixedly secured on the contact pieces 6 and 7 across the ends 6*a*, 6*b* and 7*a*, 7*b* of the contact pieces 6 and 7, respectively. The aforementioned stopper members 8 and 9 are made of insulating material so as to electrically insulate the stationary contact pieces 6 and 7 from each other. The touch response sensor of this invention comprises an electrically resistant resilient or elastic member 10 of a substantially inverted V-shape in section, which member 10 has an upper inside valley portion 10*c*, a top portion 10*d* projecting upwardly and facing the projection 1*b* of the ky key 1, and downwardly flaring, forked leg portions 10*a* and 10*b*. The leg portions 10*a* and 10*b* of the resilient member 10 are so arranged that the span between the lower ends 10*a*′ and 10*b*′ thereof is substantially equal to the interval between the stopper members 8 and 9. The resilient member 10 thus formed and arranged is made of, for example, electrically conductive rubber, which contains carbon as a resistant material so that a desired resistance value is determined by changing the carbon content therein.

Figure 4:
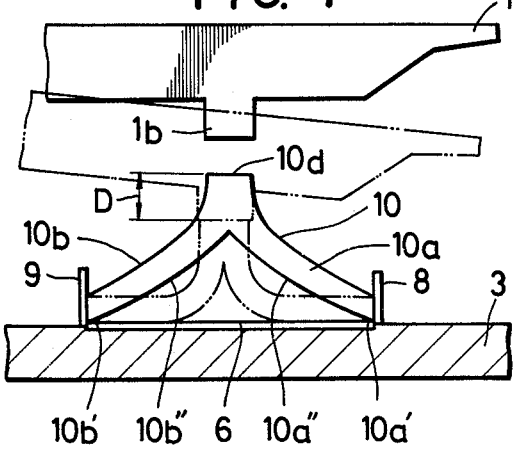
FIG. 4 is a side view of the sensor shown in FIG. 3 for explaining the operation thereof.

The resilient member 10 thus shaped is placed between the stopper members 8 and 9 on the stationary contact pieces 6 and 7 in such a manner that both the lower ends 10*a*′ and 10*b*′ of the respective legs 10*a* and 10*b* are in abutting engagement with the stopper members 8 and 9 at the respective ends 6*a*, 6*b* and 7*a*, 7*b* of the contact pieces 6 and 7, as seen in FIG. 4.

In the state wherein the resilient member 10 is thus arranged, the top portion 10*d* of the resilient member 10 is located beneath the projection 1*b* of the key 1.

In FIG. 4, which shows a state wherein the key 1 is not depressed as designated by solid lines, the projection 1*b* of the key 1 is spaced with a predetermined gap from the top portion 10*d* of the resilient member 10. In this state, the resilient member 10 is maintained in the shape shown in FIG. 4 by the resilient force of the legs 10*a* and 10*b* thereof, and is in contact with the stationary contact pieces 6 and 7 at only the ends 10*a*′ and 10*b*′ of the respective legs 10*a* and 10*b* thereof. The contact is made in such a small area that it is substantially a line contact. Since the resilient member 10 is made of the resistant material as described above, the stationary contact pieces 6 and 7 are thus in contact with the resilient member 10 with extremely high resistance.

Upon depression of the key 1, the resistant resilient member 10 is accordingly depressed at the top portion 10*d* thereof by the projection 1*b* of the key 1. The legs 10*a* and 10*b* are bent downwardly under the depressing pressure of the key 1 so that the inner wall surfaces 10*a*″ and 10*b*″ of the respective legs 10*a* and 10*b* partly come into contact with the contact pieces 6 and 7 as designated by two-dotted broken lines in FIG. 4. Then, the area where the inner surfaces 10*a*″ and 10*b*″ of the legs 10*a* and 10*b* are in contact with the contact pieces 6 and 7 increases responsive to the increase of the key depressing pressure. Therefore, the resistance value between the contact pieces 6 and 7 decreases as the aforedescribed contacting area increases.

Inasmuch as the resistant resilient member 10 is formed substantially in the inverted V-shape in section, the deeper the resilient member 10 is depressed by the depression of the key 1, the smaller becomes a falling rate D, which is a length or distance in mm of the resilient member 10 fallen downwardly relative to change $\Delta P$ of the key depressing pressure P. Even if, therefore, the key 1 is depressed with a considerable force, the entire surfaces of the stationary contact pieces 6 and 7 will not contact with the inner wall surfaces 10*a*″ and 10*b*″ of the legs 10*a* and 10*b*. More specifically, even though the key 1 is further depressed after the initial depression of the key 1, the change of the resistance between the stationary contact pieces 6 and 7 will not become saturated. Thus, "further variations" of the resistance change between the contact pieces 6 and 7 can be obtained by the further depression of the key after the initial and normal depression of the key.

It will be understood that the touch response can be detected in response to the key depression on the basis of the change of the resistance value between the stationary contact pieces 6 and 7 and also that the "further variations" of the resistance value between the contact pieces 6 and 7 can be attained thereby.

It is to be noted that if the conductive resilient member 10 is so treated that the resistance is provided only on the inner surfaces 10*a*″ and 10*b*″ of both the leg portions 10*a* and 10*b* thereof to use a surface current only, irregularity in the resistance values caused by the respective production lot can be reduced.

Figure 5:
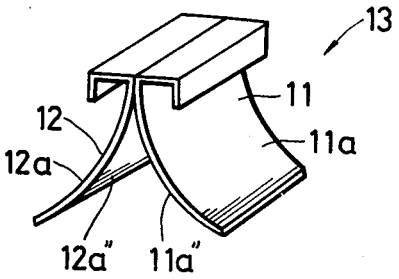
FIG. 5 is a perspective view showing another example of substantially inverted V-shape conductive resilient member used in touch response sensor according to the invention.

FIG. 5 shows another example of the resistant resilient member 10 used for the touch response sensor of this invention, Two pieces of leaf springs 11 and 12 are bent as illustrated in FIG. 5, and the top inside portions of the bent springs 11 and 12 are fixedly secured to each other in such a manner that leg portions 11*a* and 12*a* thereof are flared so as to form substantially an inverted V-shape similar to the previously described resilient member 10. Then, the surfaces of the inner walls 11*a*″ and 12*a*″ facing each other of the legs 11*a* and 12*a* are surface-treated so as to have a predetermined resistance value.

It will therefore be understood that the resilient member 13 of this example will also perform the same functions as those of the resilient member 10 of the previous example.

Figure 6:
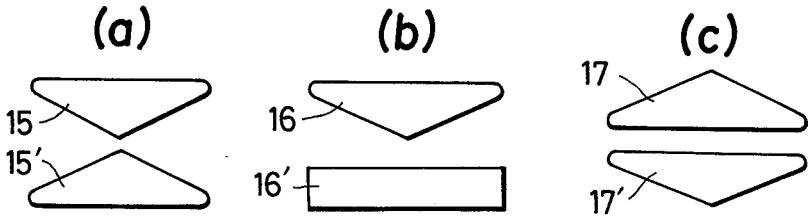
FIGS. 6(*a*) to 6(*c*) are plan views of other examples of stationary contact pieces used in the touch response sensor of the invention.

In FIGS. 6(*a*) through 6(*c*), which show various other examples of the stationary contact pieces used for the touch response sensor of this invention, the contacting areas where the respective contact pieces 15, 15′, 16, 16′ and 17, 17′ contact with the resilient member increase as the resilient member approaches the respective central portions of the contact pieces 15, 15′; 16, 16′ and 17, 17′.

The deeper the key 1 is depressed so that the resilient member 10 is downwardly depressed, the smaller becomes the falling rate D of the member 10 with respect to the change $\Delta P$ of the key depressing pressure P, and, accordingly, the increasing rate $\Delta S$ of the contacting areas of the inner wall surfaces 10*a*″ and 10*b*″ of the respective legs 10*a* and 10*b* with the stationary contact pieces 6 and 7 becomes smaller with the result that the resistance between the stationary contact pieces 6 and 7 does not linearly vary with the key depressing pressure. Simultaneously, since the changing rate of the resistance value therebetween becomes small, the after-control sometimes becomes difficult in the previously described touch response sensor. However, by forming the stationary contact pieces of the sensor in the manner of the present example, i.e. such that the contacting areas of the respective contact pieces 15, 15′; 16, 16′ and 17, 17′ with the resilient member 10 increase as the member 10 approaches the central portions of the respective contact pieces 15, 15′; 16, 16′ and 17, 17′ as designated in FIGS. 6(*a*) through 6(*c*), even if the falling rate D of the resilient member 10 is small, the contacting area of the contact pieces 15, 15′; 16, 16′ and 17, 17′ with the resilient member 10 can be increased in proportion to the increase of the key depressing pressure. It will therefore be understood that a richer musical expression depending upon the key depressing pressure can be achieved than in the case wherein the contact pieces 6 and 7 are formed in a rectangular shape as shown in FIG. 3.

It will also be understood that the change of the resistance value to be detected through the combination of the resilient member and the contact pieces may be provided as desired, i.e., lineary or nonlinearly, with respect to the key depressing pressure by suitably forming the contacting area of the contact pieces.

Figure 7:
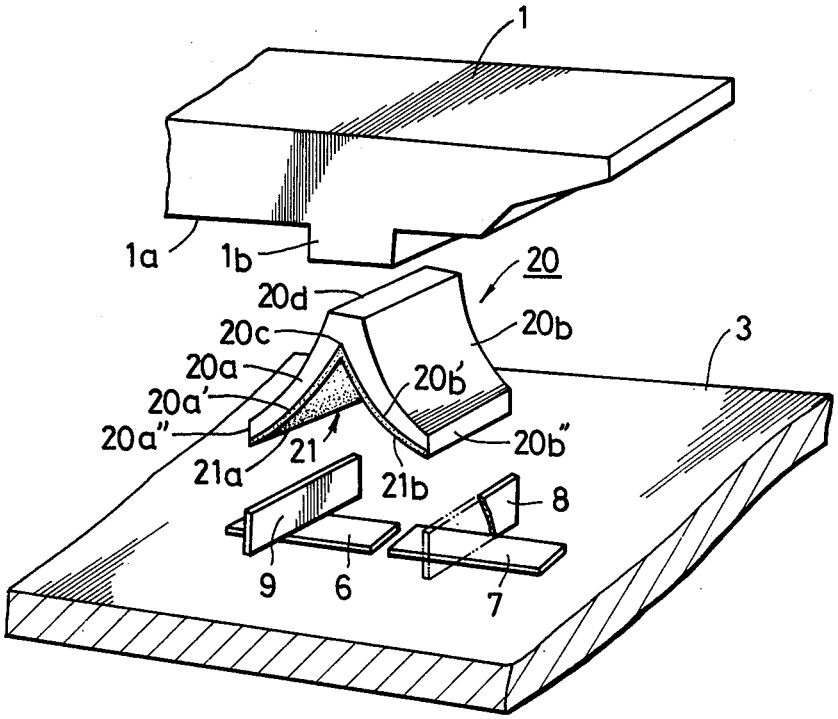
FIG. 7 is an exploded perspective view showing another embodiment of the touch response sensor according to the invention.

FIG. 7 shows another embodiment of the touch response sensor of this invention, wherein the same component parts as those shown in FIG. 3 are denoted by the same reference characters and description thereof is omitted. In this embodiment, stationary contact pieces 6 and 7 are longitudinally arranged in series with a predetermined space therebetween at a position opposite to the projection 1*b* of the key 1 on the base plate 3. Stopper or engaging members 8 and 9 are fixedly secured to the intermediates of the stationary contact pieces 6 and 7 crossing these contact pieces 6 and 7. The touch response sensor of this embodiment comprises a resilient or elastic member 20 of a substantially inverted V-shape, which member 20 has a upper inside valley portion 20*c*, a top portion 20*d* projecting upwardly and facing the projection 1*b* of the key 1, and forked leg portions 20*a* and 20*b* of a downwardly flaring form. The leg portions 20*a* and 20*b* of the resilient member 20 are so arranged that the span between the lower ends 20*a*″ and 20*b*″ thereof is substantially equal to the interval between the engaging members 8 and 9. The resilient member 20 thus formed and arranged is made of, for example, ordinary rubber.

A resistant portion 21 is formed on the inner wall surfaces 20*a*′ and 20*b*′ of the respective leg portions 20*a* and 20*b* of the resilient member 20. This resistant portion 21 is, for example, made of silicon rubber containing carbon or silver so as to form a predetermined resistance value. It is to be noted that the contents of the carbon or silver in the silicon rubber is a matter of design and therefore will not be described any further. It should be appreciated that other resistant materials may also be employed instead of the aforementioned material. The resistant resilient member 20 is thus formed. It is to be noted that the resilient member 20 and resistant portion 2 may, for example, be made integrally of conductive rubber having a predetermined resistance value.

Figure 8:
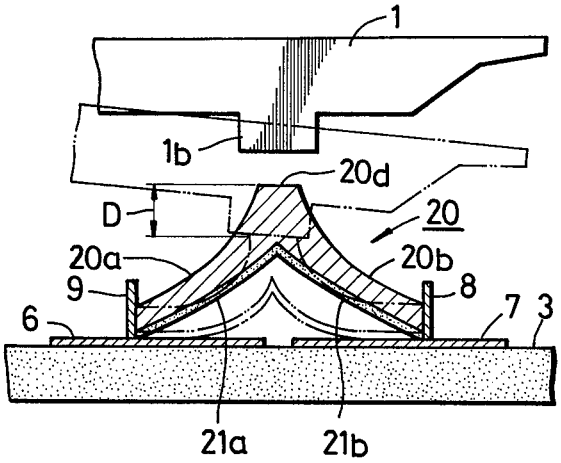
FIG. 8 is a sectional view of the sensor shown in FIG. 7 for describing the operation thereof.

The resilient member 20 thus shaped is placed on the stationary contact pieces 6 and 7 in such a manner that the lower ends 20*a*″ and 20*b*″ of the legs 20*a* and 20*b* are respectively in abutting engagement with the respective stopper member 8 and 9 so that the end portions of the inner resistant surfaces 21*a* and 21*b* thereof are brought into a close contact with the respective stationary contact pieces 6 and 7, as seen in FIG. 8.

In the state wherein the resilient member 20 is thus arranged, the top portion 20*d* of the resilient member 20 is located beneath the projection 1*b* of the key 1. It is to be noted that the lower ends 20*a*″ and 20*b*″ of the respective legs 20*a* and 20*b* of the resilient member 20 may preferably be adhered or bonded to the stopper members 8 and 9, respectively so as to completely retain the aforementioned configuration.

In FIG. 8 which shows the state wherein the key 1 is not depressed as designated by solid lines, the resilient member 20 is in contact with the stationary contact pieces 6 and 7 at the resistant portion 21. The contacting area is so small that it is substantially a linear contact. Accordingly, the stationary contact pieces 6 and 7 are thus connected by the resilient member 20 with an extremely high resistance, i.e., with the entire resistance value of the resistant portion 21 of the resilient member 20.

Upon depression of the key 1, the inner surfaces 21*a* and 21*b* of the resistant portion 21 are partly brought into contact with the contact pieces 6 and 7 as designated by two-dotted broken lines in FIG. 8. Then, the contacting area of the inner surfaces 21*a* and 21*b* with the contact pieces 6 and 7 increases in response to the increase of the key depressure. Therefore, the length or distance of connection of the stationary contact pieces 6 and 7 by the resistant portion 21 of the resilient member 20 becomes shorter with the result that the resistant value between the contact pieces 6 and 7 will decrease. More specifically, the resistance between the contact pieces 6 and 7 will vary in response to the key depressing pressure.

It is to be noted that even if the key 1 is depressed with a considerable strength or force, the entire surfaces of the contact pieces 6 and 7 will not contact with the inner surfaces 21*a* and 21*b* of the resistant portion 21 of the resilient member 20. More specifically, even though the key 1 is further depressed after the depression of the key 1, the change of the resistance between the contact pieces 6 and 7 will not become saturated. Thus, the "further variations" of the resistance change between the contact pieces 6 and 7 can be obtained by the further depression of the key after the initial depression of the key.

Figure 9:
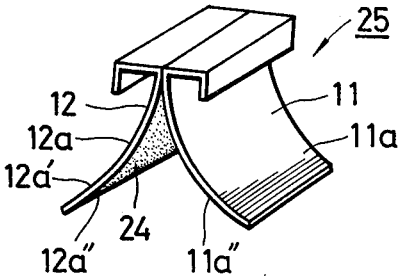
FIG. 9 is a perspective view of another example of the substantially inverted V-shape resistant resilient member used in the touch response sensor of the invention.

FIG. 9 shows another example of the resistant resilient member used for the touch response sensor of this invention, wherein the same component parts as those shown in FIG. 5 are denoted by the same reference characters and description thereof is omitted. The surfaces of the inner walls 11*a*" and 12*a*" facing each other of the respective legs 11*a* and 12*a* are surface-treated so as to provide a predetermined resistance value to a resistant portion 24 of a resilient member 25.

It will therefore be understood that the resilient member 25 of this example will also perform the same functions as those of the resilient member 20 shown in FIGS. 7 and 8.

It should be understood from the foregoing description that since the touch response sensor of this invention is thus constructed, it is extremely compact and light, and it can be directly arranged on a printed substrate with easy assembling. It should also be understood that since the sensor of this invention is simple in construction, it becomes less expensive. It should also be appreciated that even if the key is further depressed after the depression of the key being played, the resistance change will not be saturated and the "further variations" of the resistance value between the contact pieces may be obtained thereby.

Figure 10:
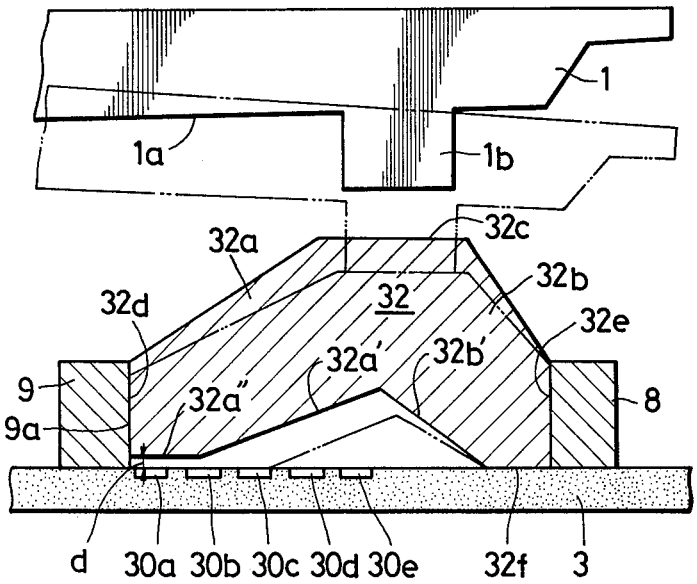
FIG. 10 is an enlarged sectional view showing another embodiment of the sensor according to the invention.

In FIG. 10, which shows another embodiment of the touch response sensor of this invention, wherein the same component parts as those shown in FIG. 3 are designated by the same reference characters and description thereof is omitted, a plurality of stationary contact pieces 30*a* through 30*e* of substantially rectangular shape are arranged in parallel with a predetermined space therebetween on a base plate 3 under the key 1. The contact pieces 30*a* through 30*e* are formed or attached to the base plate 3 by printing or other means.

Figure 11:
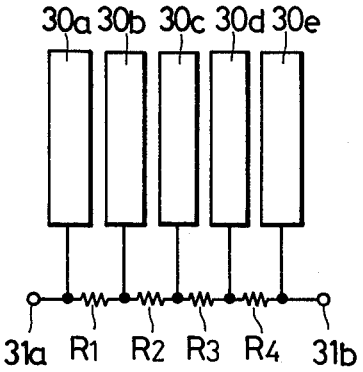
FIG. 11 is a plan view of another example of the stationary contact pieces of the sensor shown in FIG. 10.

As shown in FIG. 11, which shows one example of the arrangement of the stationary contact pieces, the respective contact pieces 30*a* through 30*e* are connected through resistors $R_1$ through $R_4$ connected in series to terminals 31*a* and 31*b*. The resistors $R_1$ through $R_4$ may be those obtainable in the market or may be formed between the respective stationary contact pieces 30*a* through 30*e* by means of deposition or the like.

The touch response sensor of this embodiment comprises an electrically conductive resilient or elastic member 32 of a substantially inverted V-shape, while member 32 has two leg portions 31*a* and 32*b* formed such that one leg portion 32*a* is asymmetrically longer than the other leg portion 32*b* as shown in FIG. 10. The resilient member 32 thus shaped is placed between the stopper members 8 and 9 fixedly secured onto the base plate 3 in such a manner that the respective contact pieces 30*a* through 30*e* are all located under the longer leg 32*a* and facing the inner surface 32*a*' of the leg 32*a* with a predetermined space and that the side and bottom ends 32*e* and 32*f* of the short leg 32*b* of the member 32 are fixedly secured or adhered to the stopper member 8 and base plate 3, respectively, and also that the side end 32*d* of the long leg 32*a* of the member 32 is in slidable contact with the side wall 9*a* of the stopper member 9 and the bottom end 32*a*" of the long leg 32*a* the member 32 is spaced with a predetermined gap *d* from the contact piece 30*a*.

The resilient member 32 also has a top portion 32*c* projecting upwardly and facing the projection 1*b* of the key 1 with a predetermined space.

In the state wherein the resilient member 3 is thus arranged and the key 1 is not depressed as designated by solid lines in FIG. 10, the resilient member 32 is maintained in shape by means of the resilient force acting on the leg portion 32*b* thereof and is not in contact at the inner surface 32*a*' thereof with any of the contact piece 30*a* through 30*e*. Therefore, the respective contact pieces 30*a* through 30*e* are not connected by the conductive resilient member 32 with the result that the resistance R of the resistors $R_1$ through $R_4$ between the terminals 31*a* and 31*b* is at a maximum value, i.e. the sum of the respective resistances $(R_1 + R_2 + R_3 + R_4)$ of the resistors $R_1$ through $R_4$.

Upon depression of the key 1, the conductive resilient member 32 is accordingly depressed at the top portion 32*c* thereof by the projection 1*b* of the key 1. The leg 32*b* of the resilient member 32 is then bent downwardly in response to the depressing pressure of the key 1. When the depressing pressure of the key 1 is weak, the leg 32*b* of the member 32 is bent slightly in such a manner that the side end 32*d* thereof slides downwardly along the side wall 9*a* of the stopper member 9 so that the bottom end 32*a*" thereof is brought into contact with the contact pieces 30*a* and 30*b*. Accordingly, the resistance $R_1$ between the contact pieces 30*a* and 30*b* is short-circuited by the resilient member 32 and the resistance R between the terminals 31*a* and 31*b* consequently becomes the sum of the resistances $(R_2 + R_3 + R_4)$ of the resistors $R_2$ through $R_4$.

Upon further depression of the key 1, the leg 32*a* is bent to a greater degree than the leg 32*b* as shown by two-dotted broken lines in FIG. 10, because the leg 32*a* is longer than the leg 32*b*. Asuming that the inner surface 32*d* of the member 32 is brought into contact, for example, with the contact pieces 30*a* through 30*c* through the further bent leg 32*a*, the resistors $R_1$ and $R_2$ between the contact pieces 30*a* and 30*c* are short-circuited. Therefore, the resistance R between the terminals 31*a* and 31*b* becomes the sum of the resistances $(R_3 + R_4)$ of the resistors $R_3$ and $R_4$, thereby being reduced further.

Upon further stronger depression of the key 1, the inner surface 32*a*' of the leg 32*a* of the member 32 contacts with all the contact pieces 30*a* through 30*e* with the result that all the resistors $R_1$ through $R_4$ between the terminals 31*a* and 31*b* are short-circuited. Accordingly, the resistance R between the terminals 31*a* and 31*b* becomes zero.

Upon release of the depressed key 1, the resilient member 32 is returned to the original position or state in the respective legs 32*a* and 32*b* due to the resilient force acting thereon. Consequently, the inner surface 32*a*' of the leg 32*a* of the member 32 are separated upwardly from all the contact pieces 30*a* through 30*e*. Accordingly, the resistance R between the terminal 31*a* and 31*b* becomes the original sum value ($R_1 + R_2 + R_3 + R_4$).

Thus, the touch response sensor of this embodiment can detect the variations of the resistance value responsive to the key depression. Therefore, assuming that the terminals 31*a* and 31*b* are, for example, connected to a known charging and discharging circuit (not shown), the volume, pitch, tone-color etc. of the musical tones can be varied in response to the depression of the key.

Figure 12:
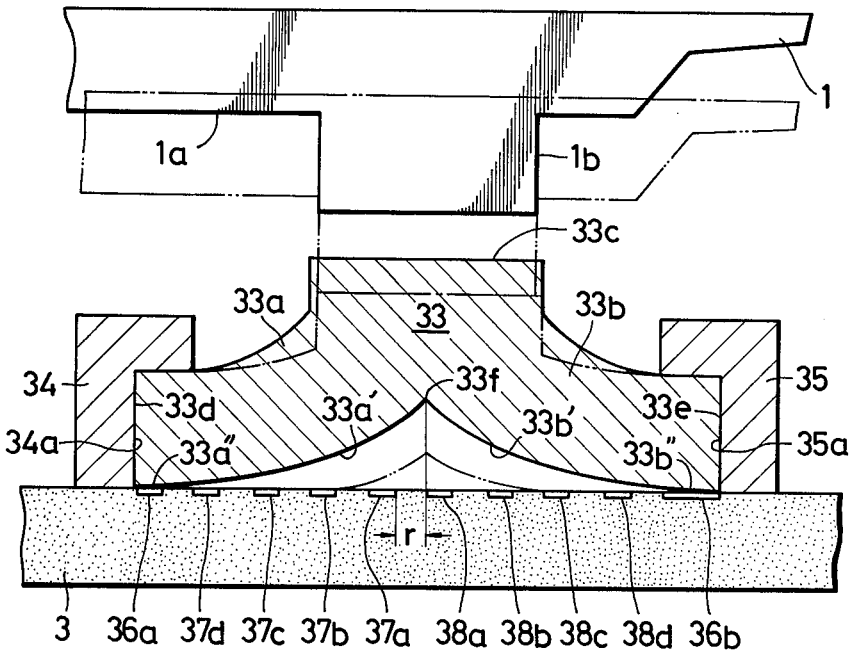
FIG. 12 is an enlarged sectional view showing another embodiment of the sensor of this invention.

FIG. 12 shows another embodiment of the touch response sensor of this invention, wherein the same component parts as those shown in FIGS. 3 and 10 are designated by the same reference characters and description thereof is omitted. The touch response sensor of this embodiment comprises an electrically conductive resilient member 33 formed symmetrically in a substantially inverted V-shape in section.

It will be understood that the inner surfaces 33*a*′ and 33*b*′ of both legs 33*a* and 33*b* of the member 33 are covered with silicon rubber and carbon so as to form an electrically conductive surface. The resilient member 33 is located and arranged in the same manner as the resilient member 10 shown in FIG. 3 except that both ends 33*d* and 33*e* of the legs 33*a* and 33*b* are engaged tightly within the recesses 34*a* and 35*a* of respective stopper members 34 and 35 fixedly secured onto the base plate 3.

A pair of common contact portions 36*a* and 36*b* of common contact piece 36 of a substantially rectangular shape are arranged in the vicinities of the stopper members 34 and 35, respectively on the base plate 3 so as to face the inner surfaces 33*a*″ and 33*b*″ of the resilient member 33, and a plurality of stationary contact pieces 37*a* through 37*d* and 38*a* through 38*d* of a substantially rectangular shape are arranged between the contact portions 36*a* and 36*b* on the base plate 3.

Figure 13:
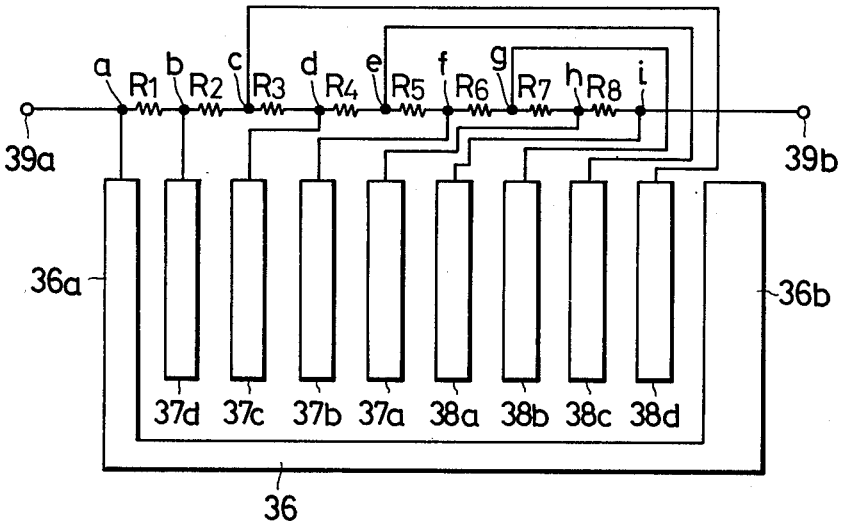
FIG. 13 is a plan view of another example of the stationary contact pieces of the sensor shown in FIG. 12.

As shown in FIG. 13, which shows another example of the arrangement of the contact pieces used for the sensor of this embodiment, the common contact piece 36 is formed in substantially U-shape. The contact pieces 37*a* through 37*d* and 38*a* through 38*d* are arranged with predetermined spaces therebetween in such a manner that their arrangement is asymmetrical with respect to the center 33*f* of the resilient member 33, i.e., the contact pieces 37*a* through 37*d* are remoter from the center 33*f* of the resilient member 33 by a distance *r* than their respective counterpart contact pieces 38*a* through 38*d*, as shown in FIGS. 12 and 13.

Upon depression of the key 1, the conductive resilient member 33 is accordingly depressed, in which case each of the contact pieces 37*a* through 37*d* is brought into contact with the electrically conductive inner surface 33*a*′ of the resilient member 33 earlier than each correspondingly located one of the contact pieces 38*a* through 38*d* being contacted by the surface 33*b*′. More specifically, the inner surfaces 33*a*′ and 33*b*′ will alternately and sequentially contact with the contact pieces 37*a* through 37*d* and 38*a* through 38*d* in the order of 37*d*, 38*d*, 37*c*, 38*c* . . . 37*a*, 38*a*.

As shown in FIG. 13, resistors $R_1$ through $R_8$ are connected in series with each other at respective connecting points *a* through *i* between terminals 39*a* and 39*b*, and the contact portion 36*a* of the common contact piece 36 is also connected to the connecting point *a*. The contact pieces 37*a* through 37*d* and 38*a* through 38*d* are respectively connected alternately to the connecting points *b* through *i* in the order of 37*d*, 38*d*, 37*d*, 38*c* . . . , 37*a*, 38*a*, as shown in FIG. 13.

In the state wherein the resilient member 33 is thus arranged and the key 1 is not depressed as designated by solid lines in FIG. 12, only the cottom ends 33*a*″ and 33*b*″ of the member 33 are in contact with the contact portions 36*a* and 36*b* of the common contact piece 36 but other contact pieces 37*a* through 37*d* and 38*a* through 38*d* are not in contact with the inner surfaces 33*a*′ and 33*b*′, respectively of the member 33 at all. Consequently, the resistance R of the resistors $R_1$ through $R_8$ between the terminals 39*a* and 39*b* is at a maximum, i.e. the sum of the respective resistances ($R_1 + R_2 + \ldots, +R_8$) of the resistors $R_1$ through $R_8$.

Upon depression of the key 1, both the legs 33*a* and 33*b* of the resilient member 33 are symmetrically bent downwardly in response to the depressing pressure of the key 1 as designated by two-dotted broken lines in FIG. 12, so that the inner surfaces 33*a*′ and 33*b*′ of the member 33 are successively and alternately brought into contact with the contact pieces 37*a* through 38*d* in the order of 37*d*, 38*d*, 37*c*, 38*c*, . . . 37*a*, 38*a* as previously described. Therefore, the resistors $R_1$ through $R_8$ are in turn short-circuited therebetween with the result that the resistance R of the resistors $R_1$ through $R_8$ between the terminals 39*a* and 39*b* is thus reduced.

When the depressed key 1 is released, the legs 33*a* and 33*b* of the resilient member 33 move upwardly and are returned to the original position due to the resilient force acting thereon with the result that they are separated from the contact pieces 37*a* through 38*d*. Consequently, the resistance R of the resistors $R_1$ through $R_8$ between the terminals 39*a* and 39*b* becomes the original sum value ($R_1 + R_2 + , \ldots + R_8$).

Thus, the touch response sensor of this embodiment can also detect the V variations of the resistance value responsive to the key depressing pressure.

Figure 14:
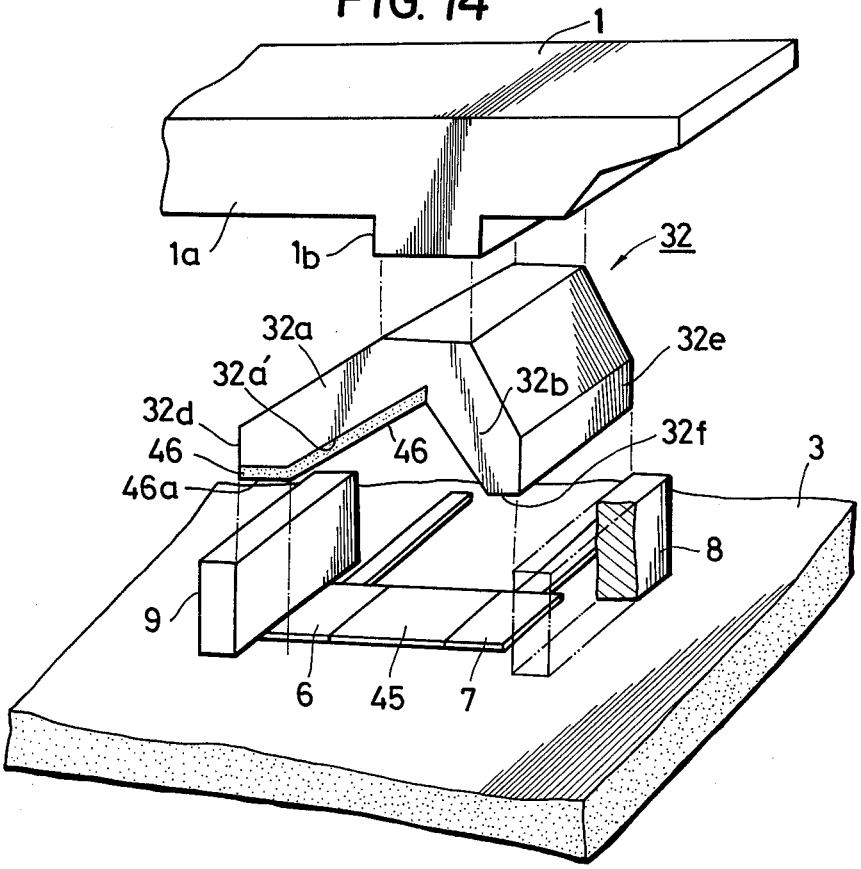
FIG. 14 is an enlarged fragmentary exploded perspective view of another embodiment of the sensor of this invention.

In FIG. 14, which shows another embodiment of the touch response sensor of this invention, wherein the same component parts as those shown in FIGS. 3 and 10 are designated by the same reference characters and description thereof is omitted, stationary contact pieces 6 and 7 of a substantially rectangular shape are provided in parallel with a predetermined space on the base plate 3 under the key 1.

An electrically resistant piece 45 of a substantially rectangular shape is provided between the contact pieces 6 and 7 on the base plate 3 so as to engage between the pieces 6 and 7. This resilient pieces 45 may be formed on the base plate 3 by deposition or other suitable method.

The resistant piece 45 is, for example, formed of silicon rubber containing carbon or silver so as to provide a predetermined resistance value. It is to be noted that the content of the carbon or silver in the carbon or silver group material is a matter of design and will not be therefore described any further. It should be appreciated that other resistant materials may also be employed instead of the aforementioned material.

The conductive resilient member 32 is, for example, made of ordinary rubber, and an electrically conductive portion 46 is formed on the inner surface 32*a*′ of one leg 32*a* of the member 32. This conductive portion 46 is, for example, made of electrically conductive rubber and is integrally formed with the resilient member 32. It is to be noted that the conductive portion 46 is not formed separately from the member 32 but is integrally formed with the resilient member 32 with the conductive rubber material. The end 46*a* of the conductive portion 46 is constructed to have substantially the same area as that of the contact piece 6 and the length of the inclined portion 46*b* of the portion 46 is constructed to be longer than the length of the resistant piece 45, i.e., the distance between the contact pieces 6 and 7.

The contact pieces 6 and 7 and the resistant piece 45 are arranged under the leg 32*a* of the resilient member 32 in such a manner that the end 46*a* of the conductive portion 46 is in close contact with the contact piece 6 and the inclined portion 46*b* of the portion 46 is spaced from the resistant piece 45 and the contact piece 7. The resilient member 32 is so arranged that it is retained at the side ends 32*d* and 32*e* of the respective legs 32*a* and 32*b* between the stopper members 8 and 9 and held at the bottom end 32*f* of thee leg 32*b* on the base plate 3.

Figure 15:
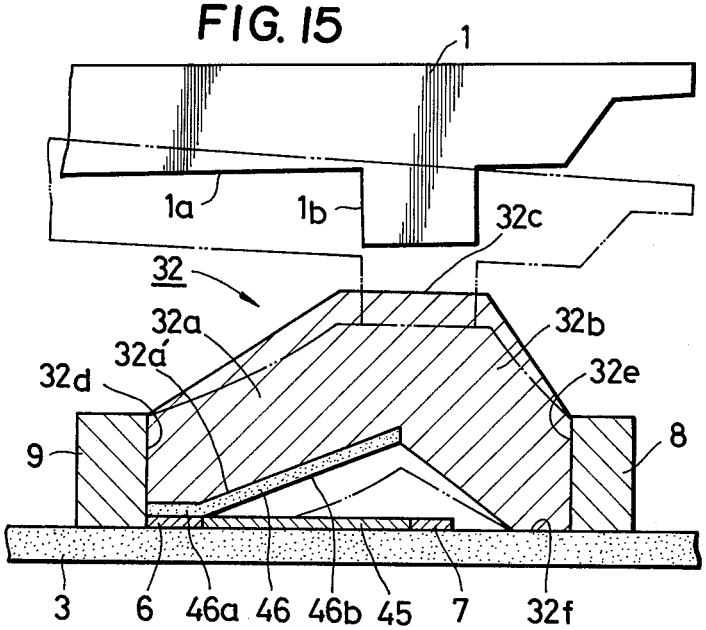
FIG. 15 is a side view of the sensor shown in FIG. 14 for describing the operation thereof.

In the state wherein the resilient member 32 is thus arranged and the key 1 is not depressed as designated by solid lines in FIG. 15, which shows the operational state of the touch response sensor shown in FIG. 14, the resilient member 32 is maintained in configuration due to the resilient force acting on the legs 32*a* and 32*b* thereof as shown and the inclined portion 46*b* of the conductive portion 46 is separated from the resistant piece 45. Accordingly, the resistance between the contact pieces 6 and 7 becomes the sum of resistance value of the resistant piece 45 and therefore is at maximum.

Upon depression of the key 1, the conductive resilient member 32 is thus depressed at the top portion 32*c* thereof by the projection 1*b* of the key 1. Accordingly, the legs 32*a* and 32*b* of the resilient member 32 are then bent downwardly in response to the depressing pressure of the key 1. The inclined portion 46*b* of the conductive portion 46 is gradually brought into contact with the resistant piece 45 from the contact piece 6 side as the leg 32*a* of the member 32 is bent downwardly with the result that it will short-circuit the resistant piece 45 by the amount contact by the inclined portion 46*b* of the portion 46. Consequently, the resistance between the contact pieces 6 and 7 decreases to that degree.

Upon further strong depression of the key 1, the leg 32*a* is further downwardly bent so that the inclined portion 46*b* of the conductive portion 46 will further short-circuit the resistant piece 45 with the result that the resistance between the contact pieces 6 and 7 is further reduced.

Upon release of the depressed key 1, the resilient member 32 is returned to the original position or state in the respective legs 32*a* and 32*b* due to the resilient force acting thereon. Consequently, the inclined portion 46*b* of the conductive portion 46 is separated upwardly from the resistant piece 45 and the contact piece 7. Accordingly, the resistance value between the contact pieces 6 and 7 is reset to the original resistance value, i.e., the total resistance value of the resistant piece 45.

It should be understood from the foregoing description that if the contact pieces 6 and 7 are, for example, connected via lines (not shown) to a known voltage-controlled variable-frequency oscillator circuit, voltage-controlled variable filter circuit, voltage-controlled variable gain amplifier circuit (not shown), or the like, the volume, pitch, tone-color etc. of the musical tones can be varied in response to the voltage change caused by the resistance variations upon depression of the key.

It should also be understood that according to the touch response sensor of this invention, a very small sensor such as having width equal to that of one key can be easily formed and that since this sensor can be directly provided on the circuit substrate it is very advantageous in designing a compact circuit. It should also be understood that as the contacting resistance between the contact pieces and the conductive resilient member can be ignored by increasing the resistance value of the resistant piece formed between the contact pieces on the base plate, it can reduce irregularities of the operation among the respective keys of the instrument. It should be appreciated that the asymmetrical construction of the legs of the resilient member or the asymmetrical arrangement of the contact pieces located under the member enables provision of a large number of contact points so as to enhance the sensitivity of the key touching operation. It should also be noted that the sensor of this invention is simple in construction and suited for mass production and, accordingly, the cost of manufacture can be considerably reduced.

What is claimed is:

1. A touch response sensor for an electronic musical instrument having a plurality of keys arranged over a base plate comprising:

two stationary contact pieces provided on a base plate and spaced from each other; and an electrically resistant resilient member of a substantially inverted V-shape in section arranged above said contact pieces;

an area of contact of said resilient member with said stationary contact pieces being varied by pressing said resilient member against said stationary contact pieces for deformation thereof in response to depression of a key and variation in resistance between said stationary contact pieces being detected in response to the variation in the area of contact.

2. A touch response sensor as defined in claim 1 wherein at least one of said stationary contact pieces is of a gradually increased width toward the center portion thereof so that the rate of increase in the area of contact of said resilient member with said contact piece increases toward the center portion of said contact piece.

3. A touch response sensor as defined in claim 1 wherein said resistant resilient member comprises an insulating resilient member and a thin resistant resilient member attached to a surface of said insulating resilient member facing said stationary contact pieces.

4. A touch response sensor for an electronic musical instrument having a plurality of keys arranged over a base plate comprising:

a plurality of stationary contact pieces provided in parallel and spaced away from each other on a base plate;

resistors each being connected between two adjacent ones of said stationary contact pieces; and an electrically conductive resilient member of a substantially inverted V-shape in section having two leg portions extending over said stationary contact pieces;

said stationary contact pieces being short-circuited by pressing said resilient member against said stationary contact pieces for deformation thereof in response to depression of a key and variation in resistance responsive to the key depression being thereby detected.

5. A touch response sensor as defined in claim 4 wherein one of the two leg portions of said conductive resilient member is longer than the other and said stationary contact pieces are disposed only under the longer leg portion.

6. A touch response sensor as defined in claim 4 wherein the two leg portions of said conductive resilient member are of a substantially equal length to each other and said stationary contact pieces are arranged asymmetrically with respect to the center of said conductive resilient member.

7. A touch response sensor for an electronic musical instrument having a plurality of keys arranged over a base plate comprising:

two stationary contact pieces provided in a spaced relationship on a base plate and being coupled to each other through an electrically resistant member having a predetermined resistance value; and an electrically conductive resilient member of a substantially V-shape in section having two leg portions extending over said stationary contact pieces with one of the leg portions in contact with one of said stationary contact pieces;

said resilient member being brought into contact with said resistant member by deforming said resilient member in response to depression of a key in such a manner that the area of contact of said resilient member with said resistant member being varied in response to depression of the key and variation in resistance being thereby detected.

* * * * *